United States Patent [19]

Keane

[11] 4,206,922

[45] Jun. 10, 1980

[54] JIG-SAW PUZZLE DISPLAY ASSEMBLY AND METHOD

[76] Inventor: Eunice R. Keane, 11 Maeven Ave., Kingston 10, Jamaica

[21] Appl. No.: 974,355

[22] Filed: Dec. 29, 1978

[51] Int. Cl.[2] ..... A63F 9/10

[52] U.S. Cl. ..... 273/157 R

[58] Field of Search ..... 273/157 R; 35/27

[56] References Cited

U.S. PATENT DOCUMENTS

| | | | |
|---|---|---|---|
| 1,028,058 | 5/1912 | Van Nordenkampf | 273/157 UX |
| 2,002,077 | 5/1935 | Darling et al. | 273/157 R |
| 2,011,058 | 8/1935 | Krase | 273/157 R |
| 2,534,550 | 12/1950 | Frechtmann et al. | 273/157 UX |
| 2,825,568 | 3/1958 | Birsh | 273/157 R |
| 3,550,945 | 12/1970 | Resnick | 273/157 R |
| 3,606,338 | 9/1971 | Cannata | 273/157 R |

*Primary Examiner*—Anton O. Oechsle

*Attorney, Agent, or Firm*—Donald A. Kettlestrings

[57] ABSTRACT

A method and apparatus for enabling the mounting of a completed jig-saw puzzle for display and for enabling quick and easy disassembly of the mounted jig-saw puzzle. The puzzle can be assembled, mounted for display, and disassembled any number of times.

12 Claims, 11 Drawing Figures

Fig. 5.
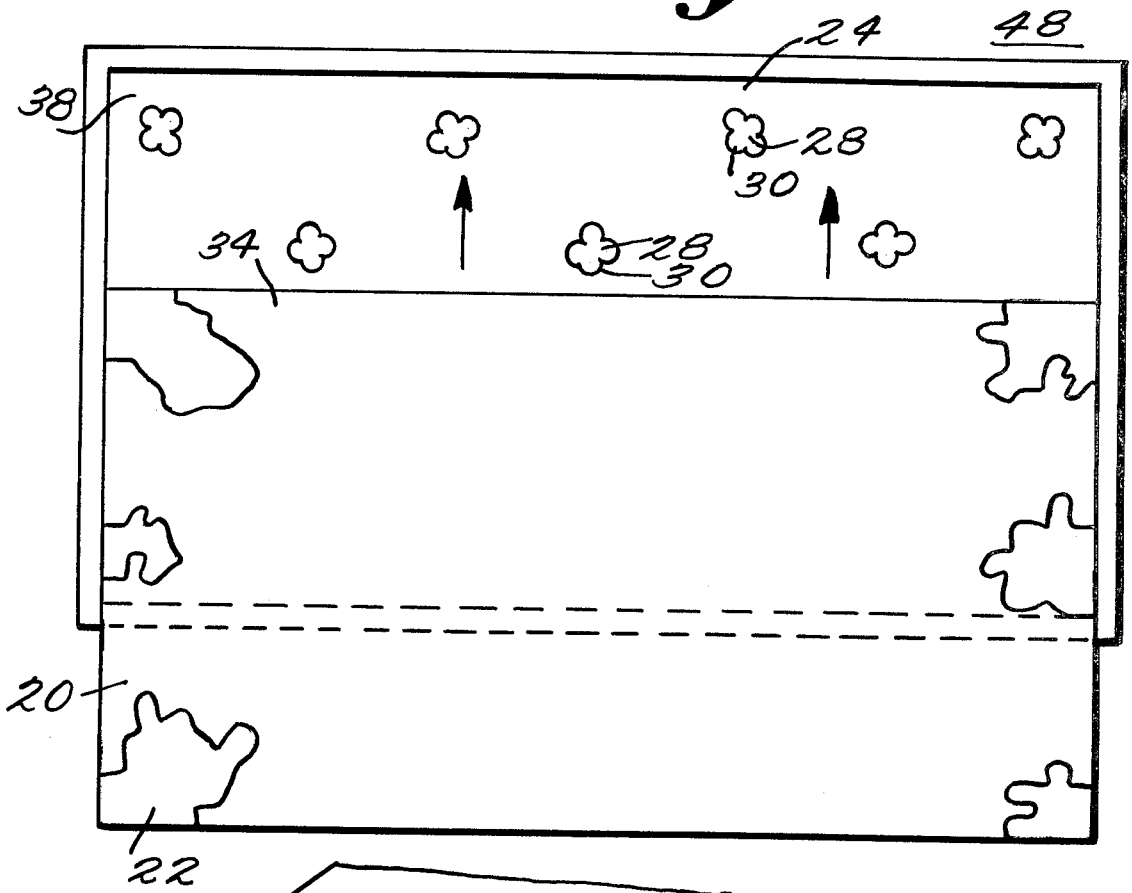
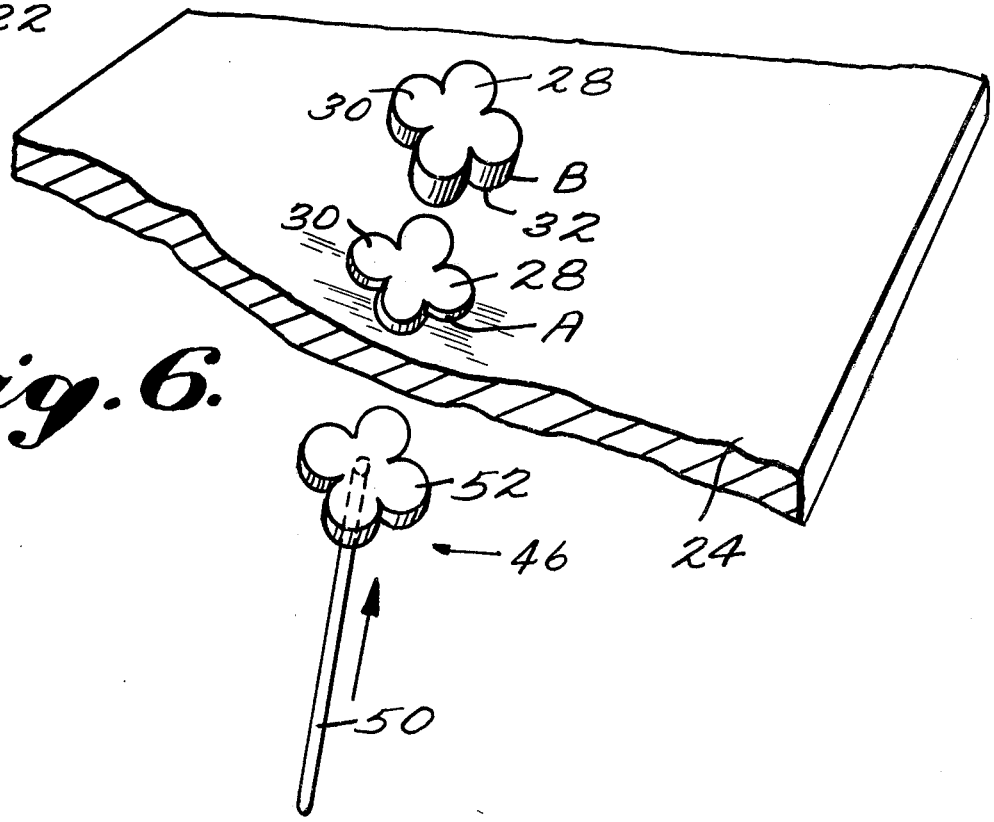
Fig. 6.

25
30
28
32
26
25
38
24

22
22
36
25
28
40
24
25

40
40

25
22
24
25

36
32
28
22

JIG-SAW PUZZLE DISPLAY ASSEMBLY AND METHOD

This invention relates to a method and apparatus for mounting a completed jig-saw puzzle for display, and more particularly to a method and apparatus for enabling a jig-saw puzzle to be repeatedly mounted for display and disassembled.

Numerous methods and devices for framing jig-saw puzzles are known, but none of the known methods or devices provides for the repeated mounting for display and easy disassembly of a jig-saw puzzle, as provided by this invention.

It is, therefore, an object of the present invention to provide a method of mounting a completed jig-saw puzzle for display.

Another object is to provide a method of mounting a completed jig-saw puzzle for display and for disassembling the mounted jig-saw puzzle.

A further object of the invention is the provision of a method for enabling the repeated mounting of a completed jig-saw puzzle for display and for enabling the repeated disassembly of the mounted jig-saw puzzle.

Still another object is to provide a method for disassembling the mounted jig-saw puzzle to enable the puzzle to be reassembled and again mounted for display.

Yet another object of the present invention is the provision of a jig-saw puzzle display assembly for displaying a completed jig-saw puzzle.

Additional objects and advantages of the invention will be set forth in part in the description which follows, and in part will be obvious from the description, or may be learned by practice of the invention. The objects and the advantages are realized and attained by means of the instrumentalities and combinations particularly pointed out in the appended claims.

To achieve these and other objects the present invention provides a method of mounting a completed jig-saw puzzle for display comprising the steps of providing a substantially flat, rigid, mounting member defining a plurality of apertures; providing a plurality of removable plug members normally positioned and held in frictional engagement within the apertures; assembling the jig-saw puzzle to be mounted; placing the completed jig-saw puzzle onto an upper surface of the mounting member with the front face of the puzzle facing upwardly and the rear face of the puzzle contacting the upper surface of the mounting member; removing predetermined ones of the puzzle pieces from the mounting member; applying adhesive to the upper surfaces of those plug members exposed to view by the removal of the puzzle pieces; replacing the removed puzzle pieces into contact with the mounting member and with the applied adhesive; and holding the replaced puzzle pieces in contact with the applied adhesive until the adhesive acts to hold the replaced puzzle pieces in position.

In accordance with the invention, the method further includes steps for removing the puzzle from the mounting member and for disassembling the jig-saw puzzle, the steps comprising positioning the mounted jig-saw puzzle in a face-down position; lifting one end of the mounted jig-saw puzzle; placing a tool against a lower surface of each of said plug members; and pushing the tool against the plug members and into the apertures of the mounting member to force the plug members from the apertures, whereby the puzzle is simultaneously disassembled and removed from the mounting member.

The invention further provides for a jig-saw puzzle display assembly comprising a substantially flat, rigid mounting member defining an upper surface and a lower surface and further defining a plurality of apertures; a plurality of removable plug members normally positioned and held in frictional engagement within the apertures, and each of these plug members defining an upper surface and a lower surface; a multi-piece, assembled, jig-saw puzzle defining a front face and a rear face, the puzzle being positioned on the mounting member with the rear face of the puzzle contacting an upper surface of the mounting member; and an adhesive located on and adhering to the upper surface of each of the plug members and adhering to the rear face of predetermined ones of the jig-saw pieces.

It is to be understood that both the foregoing general description and the following detailed description are exemplary and explanatory, but are not restrictive of the invention.

The accompanying drawings, which are incorporated in and constitute a part of this specification, illustrate an example of a preferred embodiment of the invention and, together with the description, serve to explain the principles of the invention.

FIG. 5 is a top plan view of the mounting member and illustrating the completed puzzle being placed onto an upper surface of the mounting member;

FIG. 6 is a fragmentary perspective view of the mounting member with a plug member illustrated at B in perspective and in a position removed from the mounting member, with the plug member illustrated at A partially pushed out of the mounting member, and with the deplugging tool shown in perspective;

Figure 1:
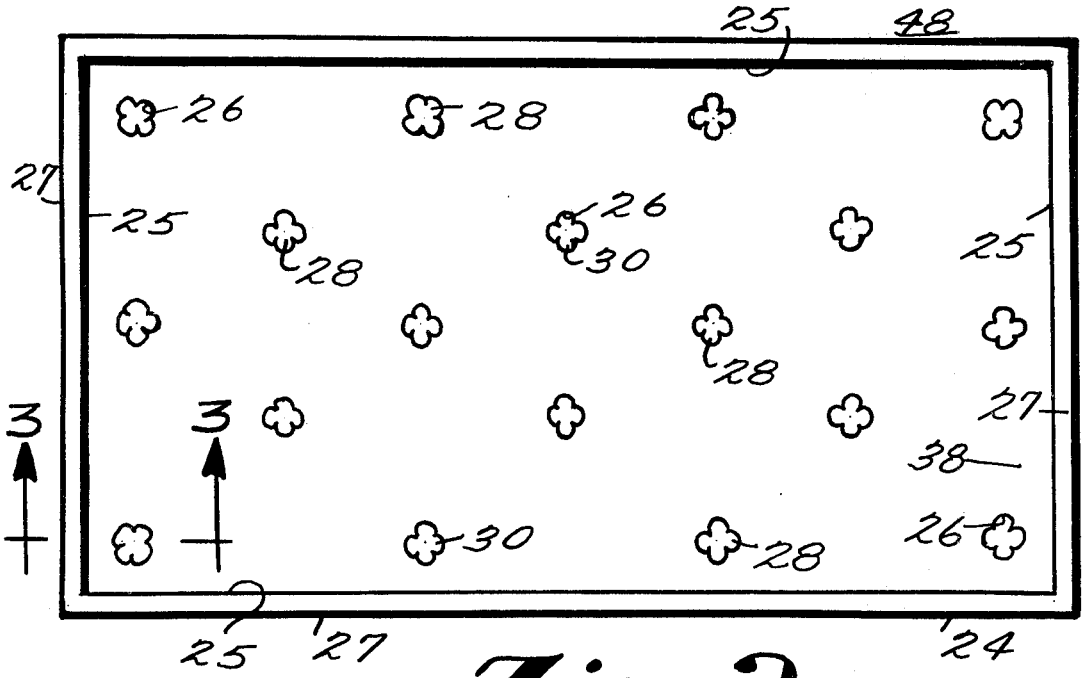
FIG. 1 is a top plan view of a preferred embodiment of the invention showing the mounting member with plug members in position within the apertures of the mounting member.
Figure 2:
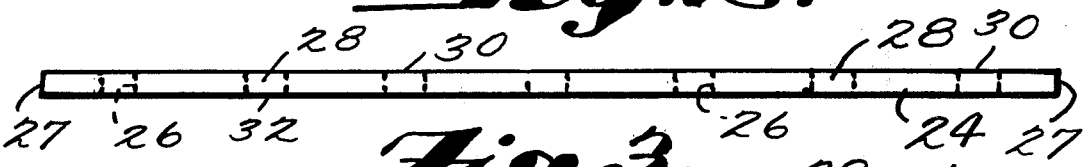
FIG. 2 is a front elevation view of the mounting member.
Figure 3:
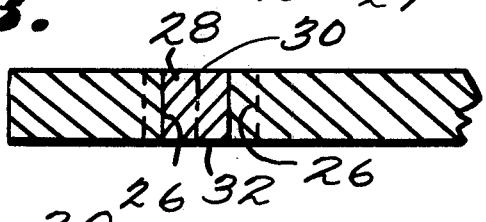
FIG. 3 is a fragmentary sectional view of the mounting member and of a plug member, taken along line 3—3 of FIG. 1 and looking in the direction of the arrows.
Figure 4:
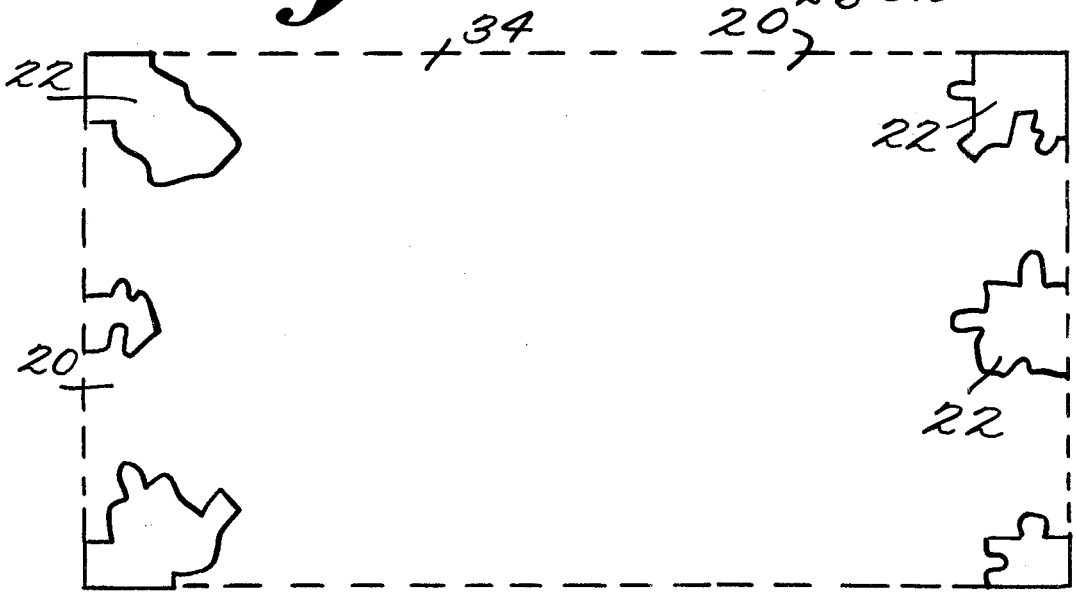
FIG. 4 is a top plan view of the completed jig-saw puzzle with some pieces of the puzzle omitted from the figure for the purpose of illustration.
Figures 7, 8, 9, 10, 11:
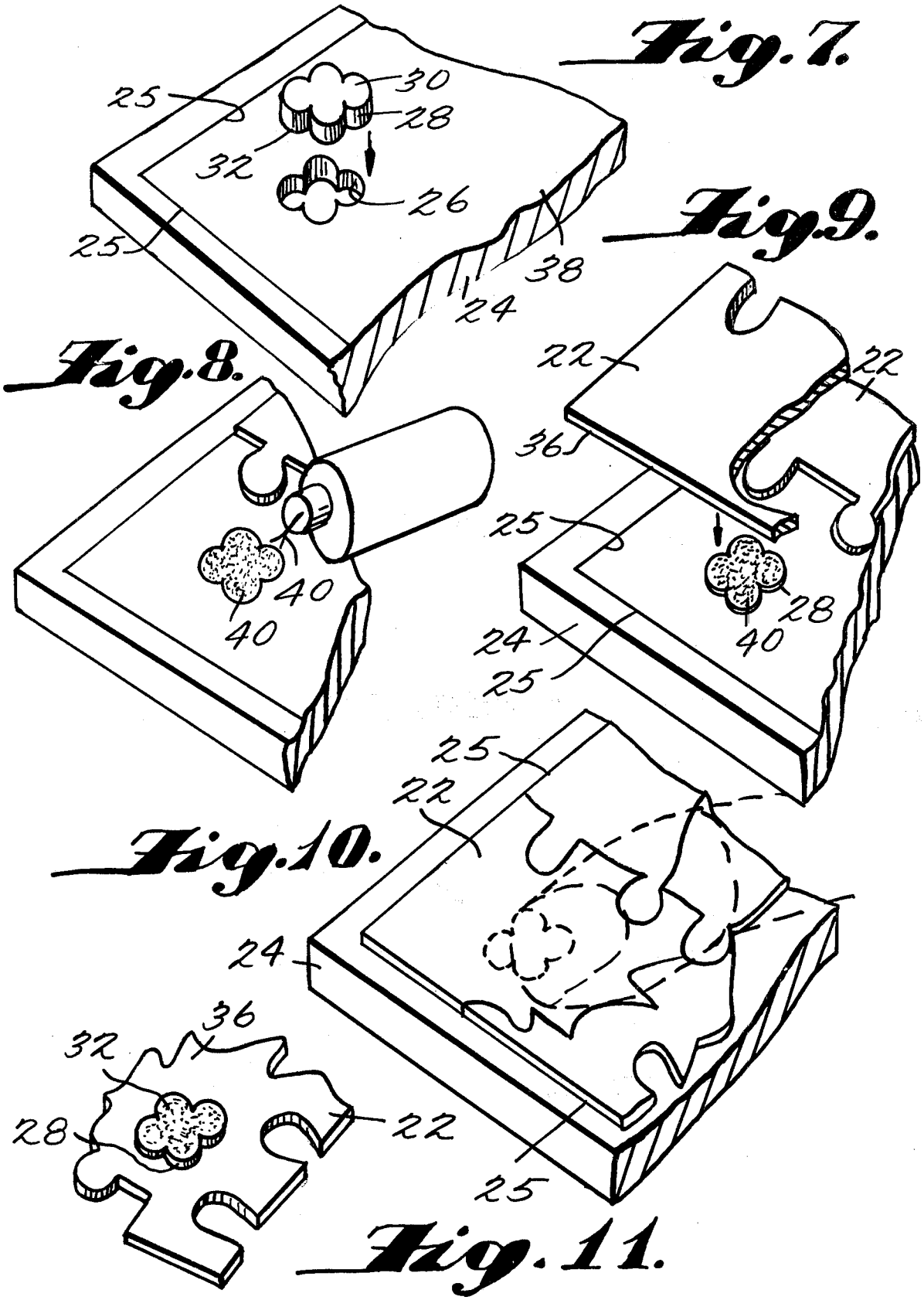
FIG. 7 is a fragmentary perspective view of the mounting member with a corner plug member in perspective and removed from the mounting member.
FIG. 8 is a fragmentary perspective view of the mounting member and showing the application of adhesive to a corner plug member.
FIG. 9 is a fragmentary perspective view of the mounting member with adhesive applied to a corner plug member.
FIG. 10 is a fragmentary perspective view of the mounting member showing the holding in place of a puzzle piece against adhesive applied to a plug member.
FIG. 11 is a bottom perspective view of a puzzle piece removed from the puzzle and from the mounting member and having a plug member attached thereto by means of adhesive.

With reference now to the drawings, wherein like reference characters designate like or corresponding parts throughout the several views, there is shown a completed jig-saw puzzle 20 having a plurality of conventional, interlocking pieces 22. A substantially flat, rigid, mounting member 24 is provided which defines a plurality of apertures 26. Mounting member 24 can be made of any suitable rigid material, such as cardboard or plastic, as examples. Lines 25 are printed or otherwise marked onto member 24 adjacent to perimeter 27 of member 24 to define an area of predetermined dimensions for receiving puzzle 20 of like dimensions.

A plurality of removable plug members 28 are normally positioned and held in frictional engagement within apertures 26, and each of the plug members defines an upper surface 30 and a lower surface 32. Assembled jig-saw puzzle 20 defines a front face 34 and a rear face 36, and the assembled puzzle is positioned on mounting member 24 within the area defined by line 25 and with rear face 36 of the puzzle contacting an upper surface 38 of the mounting member. An adhesive 40 is located on and adheres to upper surface 30 of each of plug members 28, and the adhesive also adheres to the rear face 36 of predetermined ones of jig-saw pieces 22.

The jig-saw puzzle display assembly preferably normally provides for upper surface 38 of mounting member 24 to be in substantially coplanar relationship with upper surfaces 30 of each of plug members 28. In addition, the cross sections of each of apertures 26 and of each of plug members 28, in planes substantially parallel with upper surfaces 30 and lower surfaces 32 of each of the plug members, are substantially in the shape of a four-leaf clover in order to provide greater holding and frictional engagement for each of plug members 28 within apertures 26. The four-leaf clover, cross-sectional shape has been found to provide better holding and frictional engagement for plug members 28 within apertures 26 as compared to the holding power for other cross-sectional shapes.

The process of assembling the jig-saw puzzle display provides for assembling a conventional, multi-piece, jig-saw puzzle 20. The puzzle can be assembled directly on upper surface 38 of mounting member 24 and within the area bounded by lines 25. Alternatively, the puzzle can be assembled elsewhere and then placed within the area bounded by lines 25 on upper surface 38 of the mounting member. Puzzle 20 is positioned on mounting member 24 with front face 34 of the assembled puzzle facing upwardly and with rear face 36 of the assembled puzzle contacting upper surface 38 of the mounting member. The puzzle can then be securely held to the mounting member by clips or elastic bands (not shown).

Apertures 26 and plug members 28 are preferably located and of a size so that separate plug members are positioned beneath each of the corner pieces of puzzle 20, and also, separate plug members are positioned beneath each of a plurality of pieces of the puzzle located around perimeter 42 of the puzzle. The corner pieces of puzzle 20 are removed to expose to view those plug members 28 positioned beneath the corner pieces. An adhesive 40 is then applied to upper surfaces 30 of those plug members 28 exposed to view by the removal of the corner pieces. Similarly, a number of the puzzle pieces located around the perimeter of the assembled puzzle are removed to expose additional plug members 28 to view. Adhesive 40 is then applied to upper surfaces 30 of those additional plug members.

After the adhesive has been applied to upper surfaces 30 of plug members 28, positioned beneath the corner pieces of the puzzle and beneath certain ones of the puzzle pieces located on the puzzle perimeter, each of the removed puzzle pieces is replaced in its proper position within the assembled puzzle and is placed into contact with applied adhesive 40. Each of the replaced puzzle pieces is then held in contact with the applied adhesive until the adhesive acts to hold the replaced puzzle pieces in position on the respective plug members.

One end of mounting member 24 is then lifted from work surface 48 to expose to view a lower surface 44 of the mounting member. Completed jig-saw puzzle 20 will remain in position on upper surface 38 of the mounting member because of the adhesive holding the corner pieces of the puzzle and also holding certain ones of the pieces around the puzzle perimeter. A deplugging tool 46, which will be described in more detail later, is then placed against lower surfaces 32 of each of those plug members 28 that do not already have a puzzle piece adhering to their upper surfaces 30 by means of adhesive 40. The deplugging tool is then pushed upwardly against lower surfaces 32 of those plug members 28 and partially into apertures 26 to force plug members 28 upwardly and partially out of apertures 26. This, in turn, causes puzzle pieces 22, positioned over each of the moved plug members, to be removed and raised from the completed puzzle.

Mounting member 24 is then returned to its normal horizontal position on work surface 48. Each of the raised puzzle pieces is then removed from the partially raised plug members, and adhesive 40 is applied to upper surface 30 of each of the partially raised plug members. The removed puzzle pieces are then replaced onto the upper surface of their respective plug members and into contact with applied adhesive 40. The replaced puzzle pieces are then pushed downwardly along with the partially raised plug members 28 until each of the puzzle pieces is repositioned in its proper place within completed puzzle 20. A flat, relatively heavy, object (not shown) can then be placed on top of the completed puzzle until the applied adhesive 40 dries to hold puzzle pieces 22 in place on upper surfaces 30 of plug members 28. The jig-saw puzzle display of this invention is then completely assembled and ready to be hung, framed or otherwise displayed.

An advantage of this invention provides for removing the puzzle from its display and from mounting member 24 and for disassembling the puzzle when it is desired to rework the puzzle. This is easily accomplished by first positioning the mounted jig-saw puzzle or puzzle display assembly in a face-down position on work surface 48. One end of the puzzle display assembly is then lifted from the work surface, and deplugging tool 46 is placed against each of lower surfaces 32 of plug members 28. Tool 46 is then pushed against the plug members and into apertures 26 to force plug members 28 from the apertures. Puzzle pieces 22, adhered to plug members 28, will remain adhered to the plug members, but the adhered pieces and their associated plug members will be totally removed from the display assembly. Thus, the puzzle is disassembled and is simultaneously removed from mounting member 24.

The disassembled puzzle can be reassembled at any time on mounting member 24 merely by reinserting plug members 28, which are permanently attached to some of the puzzle pieces, into the appropriate apertures 26 of the mounting member during the reassembly process. This is most easily accomplished by reassembling the puzzle directly on upper surface 38 of mounting member 24.

Deplugging tool 46 preferably comprises a handle 50 and a substantially flat, rigid member 52 attached to one end of the handle for contacting the plug members and for pushing against the lower surfaces of the plug members to move the plug members with respect to mounting member 24. Rigid member 52 of the tool is preferably of substantially the same size and shape as the cross section of plug members 28, and in accordance with a preferred embodiment of this invention that shape is substantially in the form of a four-leaf clover. The dimensions of rigid member 52 of the tool may be slightly smaller than the corresponding cross-sectional dimensions of apertures 26 and of plug members 28 in order to facilitate easy movement of the tool within the apertures. The tool may be made from plastic or from any other known materials which will provide the strength and rigidity required.

This invention provides a method and apparatus for mounting a completed jig-saw puzzle for display and for enabling the puzzle to be repeatedly disassembled and remounted, as desired.

The invention in its broader aspects is not limited to the specific details shown and described, and departures may be made from such details without departing from the principles of the invention and without sacrificing its chief advantages.

What is claimed is:

1. A method of mounting a completed jig-saw puzzle for display, comprising the steps of:

providing a substantially flat, rigid, mounting member defining a plurality of apertures;

providing a plurality of removable plug members normally positioned and held in frictional engagement within said apertures;

assembling the jig-saw puzzle to be mounted;

placing the completed jig-saw puzzle onto an upper surface of said mounting member with a front face of the puzzle facing upwardly and a rear face of the puzzle contacting said upper surface of said mounting member;

removing predetermined ones of the puzzle pieces from said mounting member;

applying adhesive to upper surfaces of those plug members exposed to view by said removal of said puzzle pieces;

replacing said removed puzzle pieces into contact with said applied adhesive; and holding said replaced puzzle pieces in contact with said applied adhesive until said applied adhesive acts to hold said replaced puzzle pieces in position.

2. A method as in claim 1 further including steps for removing the puzzle from said mounting member and for disassembling said jig-saw puzzle comprising:

positioning said mounted jig-saw puzzle in a face-down position;

lifting one end of said mounted jig-saw puzzle;

placing a tool against a lower surface of each of said plug members; and pushing said tool against said plug members and into said apertures to force the plug members from said apertures, whereby the puzzle is disassembled and removed from said mounting member.

3. A method as in claim 2 wherein predetermined ones of said apertures are positioned to be beneath corner pieces of said mounted jig-saw puzzle.

4. A method as in claim 3 wherein the step of removing predetermined ones of the puzzle pieces from said mounting member includes removing said corner pieces of the jig-saw puzzle from said mounting member.

5. A method as in claim 4 wherein the step of removing predetermined ones of the puzzle pieces from said mounting member further includes:

lifting one end of said mounting member with said completed jig-saw puzzle positioned thereon to expose to view a lower surface of said mounting member;

placing said tool against said lower surfaces of said plug members;

pushing said tool against said lower surfaces of said plug members and partially into said apertures to force the plug members partially from said apertures; and removing the puzzle pieces from said partially raised plug members.

6. A method as in claim 5 wherein the step of replacing said removed puzzle pieces includes forcing said partially extended plug members substantially completely back into said apertures.

7. A method as in claim 6 wherein a cross-section of each of said apertures and of each of said plug members is substantially in the shape of a four-leaf clover.

8. A jig-saw puzzle display assembly, comprising:

a substantially flat, rigid mounting member defining an upper surface and a lower surface and further defining a plurality of apertures;

a plurality of removable plug members normally positioned and held in frictional engagement within said apertures and each of said plug members defining an upper surface and a lower surface;

a multi-piece assembled jig-saw puzzle defining a front face and a rear face, said puzzle being positioned on said mounting member with the rear face of the puzzle contacting an upper surface of said mounting member; and an adhesive located on and adhering to said upper surface of each of said plug members and adhering to the rear face of predetermined ones of said jig-saw pieces.

9. An assembly as in claim 8 wherein said upper surface of said mounting member and said upper surfaces of each of said plug members are normally in substantially coplanar relationship with each other.

10. An assembly as in claim 9 wherein a cross-section of each of said apertures and of each of said plug members is substantially in the shape of a four-leaf clover.

11. An assembly as in claim 10 further including a tool for enabling removal of said plug members from said mounting member, said tool comprising:

a handle; and means attached to one end of said handle for contacting said plug members and for pushing against said lower surfaces of said plug members to move the plug members with respect to said mounting member.

12. An assembly as in claim 11 wherein said contacting means of said tool is of substantially the same size and shape as said cross section of said plug members.

* * * * *